US012440034B2

(12) United States Patent
Wang et al.

(10) Patent No.: US 12,440,034 B2
(45) Date of Patent: Oct. 14, 2025

(54) FOLDABLE AND DISASSEMBLE BED

(71) Applicant: Nisco Co., Ltd, Jiangsu (CN)

(72) Inventors: Wei Wang, Jiangsu (CN); Jian Xie, Jiangsu (CN); Yifan Mao, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 990 days.

(21) Appl. No.: 17/536,313

(22) Filed: Nov. 29, 2021

(65) Prior Publication Data

US 2022/0095803 A1 Mar. 31, 2022

Related U.S. Application Data

(63) Continuation-in-part of application No. 17/408,788, filed on Aug. 23, 2021, which is a continuation-in-part of application No. 16/747,842, filed on Jan. 21, 2020, now Pat. No. 11,178,974, which is a continuation-in-part of application No. 16/729,700, filed on Dec. 30, 2019, now Pat. No. 11,317,729, application No. 17/536,313 is a continuation-in-part of application No. 16/729,700, filed on Dec. 30, 2019, now Pat. No. 11,317,729.

(60) Provisional application No. 63/141,526, filed on Jan. 26, 2021, provisional application No. 62/796,172, filed on Jan. 24, 2019, provisional application No. 62/796,154, filed on Jan. 24, 2019, provisional application No. 62/790,583, filed on Jan. 10, 2019, provisional application No. 62/789,047, filed on Jan.

(Continued)

(30) Foreign Application Priority Data

Dec. 9, 2020 (CN) ..... 202022980531.5
Jan. 21, 2021 (CN) ..... 202120177973.8

(51) Int. Cl.

| | |
|---|---|
| ***A47C 19/12*** | (2006.01) |
| ***A47C 19/02*** | (2006.01) |
| ***A47C 20/04*** | (2006.01) |
| ***A47C 20/08*** | (2006.01) |

(52) U.S. Cl.

CPC ..... *A47C 19/122* (2013.01); *A47C 19/025* (2013.01); *A47C 20/041* (2013.01); *A47C 20/08* (2013.01)

(58) Field of Classification Search

CPC ..... A47C 19/12; A47C 19/122; A47C 19/124; A47C 19/025; A47C 20/041; A47C 20/08

See application file for complete search history.

(56) References Cited

U.S. PATENT DOCUMENTS 5,564,140 A * 10/1996 Shoenhair ..... A47C 19/021 403/397
5,608,932 A * 3/1997 Hasegawa ..... A47C 20/041 5/616

(Continued)

*Primary Examiner* — Justin C Mikowski
*Assistant Examiner* — Ifeolu A Adeboyejo
(74) *Attorney, Agent, or Firm* — troutman pepper locke; Tim Tingkang Xia, Esq.

(57) ABSTRACT

A foldable bed includes a bed frame structure having a back frame and a leg frame connecting to the back frame such that the back frame and the leg frame are pivotally foldable relative to one another along a length direction of the foldable bed; and a plurality of boards detachably attached onto the bed frame structure along the length direction of the foldable bed, wherein each board comprises a pair of panels arranged along a width direction of the foldable bed.

9 Claims, 7 Drawing Sheets

Related U.S. Application Data

7, 2019, provisional application No. 62/789,062, filed on Jan. 7, 2019.

(56) References Cited

U.S. PATENT DOCUMENTS

| | | | | |
|---|---|---|---|---|
| 8,935,817 | B2 * | 1/2015 | Suh | A47C 20/041 5/174 |
| 10,849,433 | B2 * | 12/2020 | Gajjar | A47C 19/021 |
| 11,160,385 | B2 * | 11/2021 | Tsai | A47C 20/041 |
| 11,744,380 | B2 * | 9/2023 | Eskridge, III | A47C 27/14 5/178 |
| 2008/0262657 | A1 * | 10/2008 | Howell | A47C 20/041 700/275 |
| 2011/0203050 | A1 * | 8/2011 | Rogers | A47C 19/005 5/285 |
| 2014/0366267 | A1 * | 12/2014 | Suh | A47C 20/041 5/174 |
| 2016/0120740 | A1 * | 5/2016 | Rawls-Meehan | A47C 31/008 601/49 |
| 2016/0198860 | A1 * | 7/2016 | Salermo | A47C 19/005 5/200.1 |
| 2017/0273467 | A1 * | 9/2017 | Huang | A47C 19/025 |
| 2017/0325592 | A1 * | 11/2017 | Suh | A47C 17/04 |
| 2017/0347807 | A1 * | 12/2017 | Totemeier | A47C 19/005 |
| 2018/0000254 | A1 * | 1/2018 | Jin | A47C 17/70 |
| 2018/0042392 | A1 * | 2/2018 | Brown | A47C 20/12 |
| 2018/0132625 | A1 * | 5/2018 | Bellingroth | A47C 20/041 |
| 2018/0352966 | A1 * | 12/2018 | Bitzounis | A47C 5/10 |
| 2019/0328593 | A1 * | 10/2019 | Choi | A61G 7/018 |
| 2020/0029700 | A1 * | 1/2020 | Bratl | A47C 20/041 |
| 2020/0367660 | A1 * | 11/2020 | Tsai | A47C 20/04 |
| 2022/0061542 | A1 * | 3/2022 | Bishop | A47C 20/041 |
| 2024/0081548 | A1 * | 3/2024 | Hanson, III | A47C 19/005 |

* cited by examiner

FOLDABLE AND DISASSEMBLE BED

CROSS-REFERENCE TO RELATED PATENT APPLICATIONS

This application claims priority to and the benefit of U.S. Provisional Patent Application Ser. No. 63/141,526, filed Jan. 26, 2021, which is incorporated herein in its entirety by reference.

This application is a continuation-in-part of U.S. patent application Ser. No. 17/408,788 filed Aug. 23, 2021, which itself is a continuation-in-part of U.S. patent application Ser. No. 16/747,842 filed Jan. 21, 2020, now U.S. Pat. No. 11,178,974, which claims priority to and the benefit of U.S. Provisional Patent Application Ser. Nos. 62/796,154 and 62/796,172 both filed Jan. 24, 2019 and is also a continuation-in-part of U.S. patent application Ser. No. 16/729,700 filed Dec. 30, 2019, which itself claims priority to and the benefit of U.S. Provisional Patent Application Ser. Nos. 62/789,062 filed Jan. 7, 2019, 62/789,047 filed Jan. 7, 2019, and 62/790,583 filed Jan. 10, 2019, which are incorporated herein in their entireties by reference.

This application is also a continuation-in-part of U.S. patent application Ser. No. 16/729,700 filed Dec. 30, 2019, which claims priority to and the benefit of U.S. Provisional Patent Application Ser. Nos. 62/789,062 filed Jan. 7, 2019, 62/789,047 filed Jan. 7, 2019, and 62/790,583 filed Jan. 10, 2019, which are incorporated herein in their entireties by reference.

This application also claims priority to and benefit of Chinese Patent Application Nos. 202022980531.5, filed Dec. 9, 2020, and 202120177973.8, filed Jan. 21, 2021, which are incorporated herein in their entireties by reference.

FIELD OF THE INVENTION

The invention generally relates to a bed, and more particular to a foldable and disassemblable bed.

BACKGROUND OF THE INVENTION

Sleep is critical for people in every aspect of their lives. Beds are necessary furniture for people to sleep on. A conventional bed usually has a fixed large bed size such as a length of 1.5 or 2.0 meters and a wide width, which not convenient for transportation and storage. Thus, it is beneficial and desirable for people to have a bed that can be folded for transportation and storage. In addition, it is also beneficial and desirable that the bed can be easily assembled to improve assembly efficiency and increase the user's assembly experience. It is further beneficial and desirable that the bed is capable of adjusting body positions based on user's sleep preference so that the user achieves maximum comfort during sleep.

SUMMARY OF THE INVENTION

In one aspect, the invention relates to a foldable bed. The foldable bed in one embodiment comprises a bed frame structure having a back frame and a leg frame connecting to the back frame such that the back frame and the leg frame are pivotally foldable relative to one another along a length direction of the foldable bed; and a plurality of boards detachably attached onto the bed frame structure along the length direction of the foldable bed, wherein each board comprises a pair of panels arranged along a width direction of the foldable bed.

In one embodiment, the foldable bed further comprises a foldable connection mechanism connecting the back frame and the leg frame such that the back frame and the leg frame are pivotally foldable relative to one another at the foldable connection mechanism.

In one embodiment, each of the back frame and the leg frame comprises a pair of side rails and being transversely spaced and longitudinally extended and being parallel to each other, each side rail having a first end and an opposite, second end; and an upper rail and a lower rail being longitudinally spaced and transversely extended, two ends of the upper rail being rigidly connected to the first ends of the pair of side rails and two ends of the lower rail being rigidly connected to the second ends of the pair of side rails, such that the upper rail and the lower rail and the pair of side rails are co-planar in a rectangle form.

In one embodiment, the back frame further comprises a crossbar connected to the pair of side rails and positioned between the upper rail and the lower rail.

In one embodiment, the back frame further comprises a back lifting bracket is pivotally connected to the crossbar.

In one embodiment, the back lifting bracket is a frame-shaped bracket.

In one embodiment, the leg frame further comprises a leg lifting bracket comprises a first lifting bracket pivotally connected to the upper rail of the leg frame, and a second lifting bracket pivotally connected to the first lifting bracket, wherein the second lifting bracket is provided with supporting legs pivotally connected to the pair of side rails of the leg frame.

In one embodiment, each of the first and second lifting brackets is a frame-shaped bracket.

In one embodiment, the foldable bed further comprises a back lifting actuator pivotally connected between the back lifting bracket and the back frame for operably driving the back lifting bracket to pivotally move in an upward rotating direction or a downward rotating direction relative to the back frame; and a leg lifting actuator pivotally connected between the leg lifting bracket and the leg frame for operably driving the leg lifting bracket to pivotally move in an upward rotating direction or a downward rotating direction relative to the leg frame.

In one embodiment, each of the back and leg lifting actuators comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation.

In one embodiment, the second end portion of the activation rod of the back lifting actuator is pivotally connected to the back lifting bracket, and the second end portion of the activation rod of the leg lifting actuator is pivotally connected to the leg lifting bracket.

In one embodiment, the motor members of the back and leg lifting actuators are pivotally connected to the back frame and the leg frame, respectively.

In one embodiment, the foldable bed further comprises a motor fixing bracket detachably connected to the back frame and the leg frame, wherein the motor members of the back and leg lifting actuators are pivotally connected to first and second ends of the motor bracket, respectively.

In one embodiment, the motor fixing bracket comprises a slot that is clamped on the cross bar of the back frame.

In one embodiment, each of the back and leg actuators comprises an electric push rod.

In one embodiment, the plurality of boards comprises a back board, a seat board, a thigh board, and a leg board, wherein length and width of a layout of one of the pair of panels of the back board and one of the pair of panels of the seat board are respectively same as length and width of a layout of one of the pair of panels of the thigh board and one of the pair of panels of the leg board, which are also respectively same as length and width of each of the back frame and the leg frame.

In one embodiment, length and width of each panel of the seat board are respectively same as length and width of each panel of the thigh board.

In one embodiment, the seat board is detachably mounted onto the pair of side rails of the back frame over the lower rail and the crossbar; the back board is detachably mounted onto the back lifting bracket of the back frame, such that the back board is operably rotatable around its lower edge in a back board downward rotating direction or a back board upward rotating direction according to operations of the back lifting actuator; and the thigh board and the leg board are detachably mounted onto the first and second lifting brackets of the leg frame, respectively, such that the thigh board is rotatable around its upper edge in a thigh board downward rotating direction or a thigh board upward rotating direction, and the leg board is rotatable around its upper edge in a leg board downward rotating direction or a led board upward rotating direction according to operations of the leg lifting actuator.

Accordingly, the foldable bed has the following beneficial and advantageous effects: the bed frame is designed in two parts to realize folding and storage, and the bed boards arranged on the bed frame are not only divided into multiple groups in the length direction of the foldable bed, but each group is also further divided into blocks in the width direction of the foldable bed, that is, each board is composed of multiple panels. Therefore, the panels can be stacked when being folded, so that the length and width dimensions of the entire foldable bed are minimized for transportation and storage, which cane reduces the transportation cost and the storage space. When assembling, only are the panels needed to fasten to the bed frame, which makes the bed assembly much easier.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
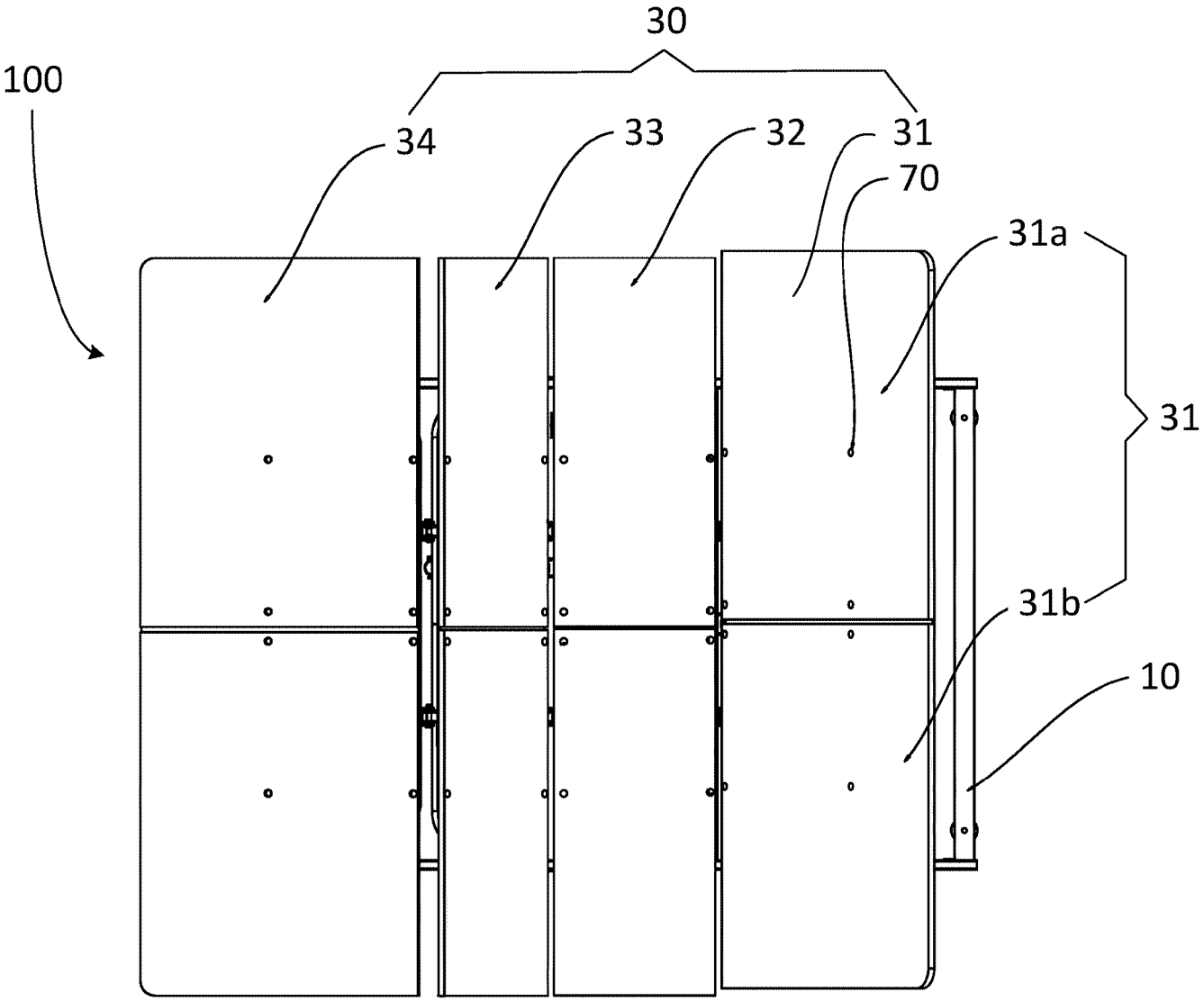
FIG. 1 shows schematically a top view of a foldable bed in a plane/flat state according to one embodiment of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprise(s)" and/or "comprising," or "include(s)" and/or "including" or "has (have)" and/or "having" or "contain(s)" and/or "containing" when used in this specification specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used in this specification, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

The description will be made as to the embodiments of the invention in conjunction with the accompanying drawings in FIGS. 1-7. In accordance with the purposes of this invention, as embodied and broadly described herein, this invention, in one aspect, relates to a foldable bed that is easily to assemble and disassemble.

Referring to FIGS. 1-6, a foldable bed 100 is shown according to one embodiment of the present invention.

Figure 4:
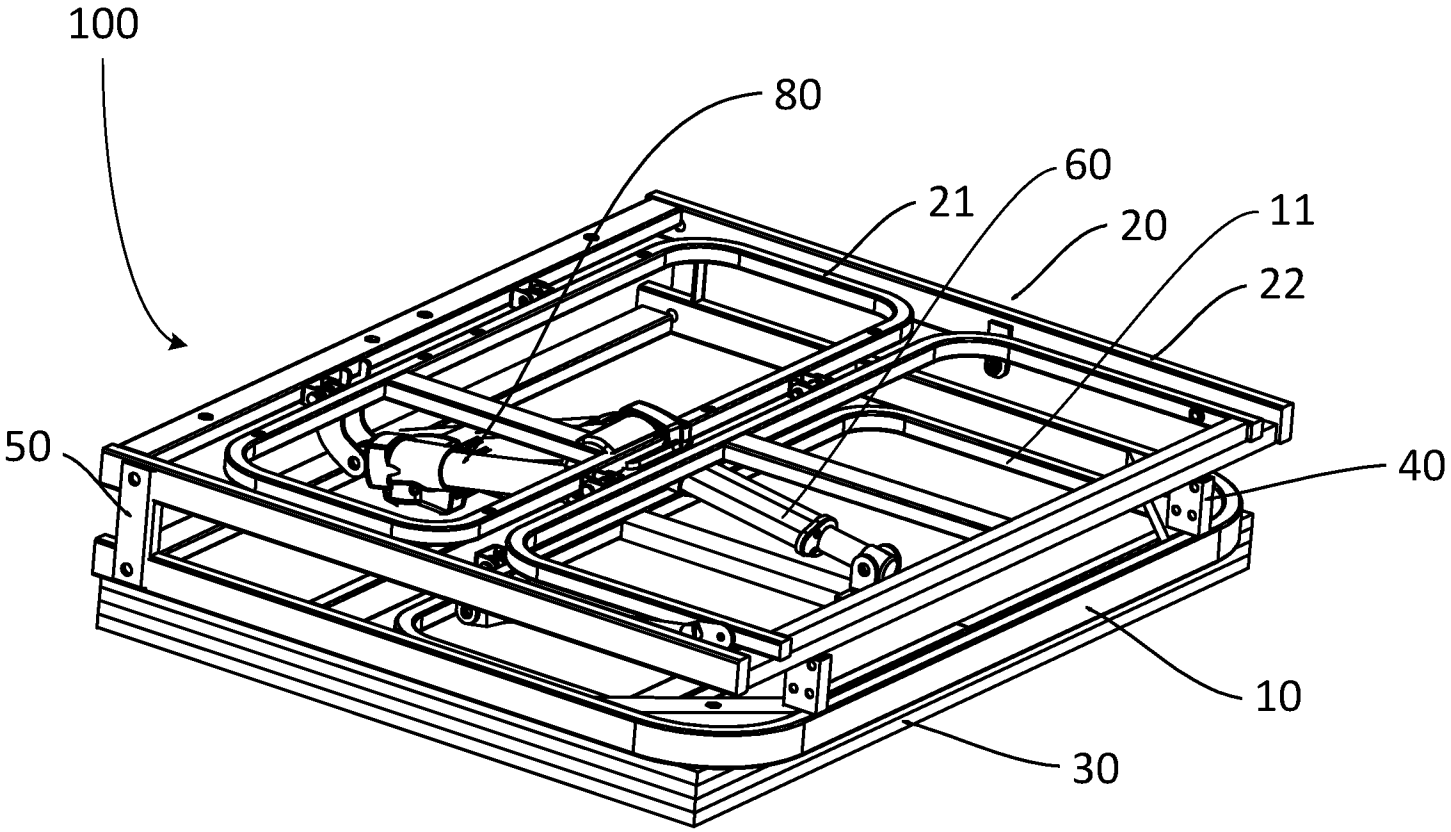
FIG. 4 shows schematically a perspective view of the foldable bed shown in FIG. 1 in a folded state.

In this exemplary embodiment, the foldable bed 100 includes a bed frame structure having a back frame 10 and a leg frame 20 connecting to the back frame 10 such that the back frame 10 and the leg frame 20 are pivotally foldable relative to one another along a length direction of the foldable bed 100, as shown in FIG. 4.

The foldable bed 100 also includes a plurality of boards (also known as platforms, bed boards, or bed platforms) 30 detachably attached onto the bed frame structure along the length direction of the foldable bed 100 (FIGS. 1-3 and 5). Each board 31 (also 32, 33, or 34) comprises a pair of panels (also known as plates) 31*a* and 31*b* arranged along a width direction of the foldable bed 100 (FIG. 1).

According to the embodiment of the foldable bed 100, the bed frame structure is designed in two parts (i.e., the back frame 10 and the leg frame 20) to be foldable, and the bed boards 30 disposed on the bed frame structure are not only designed in multiple groups (i.e., multiple boards/platforms) in the length direction of the foldable bed, but each group is also further designed in two or more blocks in the width direction of the foldable bed 100, that is, each board/platform is composed of two or more panels (e.g., two panels in the embodiment shown in FIG. 1) disposed on the bed frame structure along the width direction of the foldable bed 100, which itself is foldable along the width direction of the foldable bed 100. In some embodiments, the two or more panels of each board/platform may be hingedly connected to one another, so that the two or more panels are pivotally foldable along the width direction of the foldable bed 100.

Such a novel design of the bed boards in multiple boards with each board in two panels makes the bed boards 30 stackable on the stacked back frame 10 and leg frame 20 when folding, so that the length and width of the entire foldable bed 100 is minimized for storage and transportation, which cane reduces the transportation cost and the storage space. When assembling, only are the panels needed to fasten to the bed frame, which makes the bed assembly much easier.

For example, if the use width of the foldable bed is 1.5 meters and the use length is 2 meters, the bed size should be 1.5 meters wide and 2 meters long, and then the length of each of the back frame 10 and the leg frame 20 can be equal to or less than 1 meter, and the width each of the back frame 10 and the leg frame 20 can be less than 1.5 meters. According to the invention, each group of the bed boards 30 is designed in two flat panels, and the length and width of each flat panel are respectively less than the length and width of each of the back frame 10 and the leg frame 20, so they can be stacked on the back frame 10 and the leg frame 20 when folding. Therefore, the folded size of the foldable bed 100 is limited to the size of the back frame 10 and the leg frame 20, thereby reducing the package size for transportation and storage.

In order to facilitate stacking to further reduce the folded size, the panels are combined and then stacked. In one embodiment, the boards 30 are designed in four groups arranged along the length direction of the foldable bed 100, as shown in FIG. 1, which include a head board 31, a seat board 32, a high board 33, and a leg board 34. Each board 31/32/33/34 is further designed in two panels. For example, the head board 31 is designed to have a flat panel 31*a* and a flat panel 31*b* arranged along the width direction of the foldable bed 100. In some embodiments, the length and width of a combined layout (i.e., layout of a panel of a board combined with a panel of another board) of one of the pair of panels of the back board 31 and one of the pair of panels of the seat board 32 are respectively same as the length and width of a combined layout of one of the pair of panels of the thigh board 33 and one of the pair of panels of the leg board 34, which are also respectively same as the length and width of each of the back frame 10 and the leg frame 20.

When the boards 30 of this embodiment are stacked, the flat panels of the head board 31 are combined with the flat panels of the seat board 32, and the flat panels of the thigh board 33 are combined with the flat panels of the leg board 34, that is, large-sized flat panels and small-sized flat panels are combined to form the same length and width dimensions as that of the leg frame 20 and the back frame 10, as shown in FIG. 4. The folded whole piece of the foldable bed 100 is a rectangular parallelepiped when it is packaged, with the folded length and width minimized.

For better folding and packaging, the length and width of the seat board 32 and the thigh board 33 in one embodiment are the same, and the sizes of the back frame 10 and the leg frame 20 are the same. For ease of assembly, in one embodiment, each panel is provided with bolt holes, which are fixedly connected to the bed frame structure by, for example, bolts 70.

Figure 3:
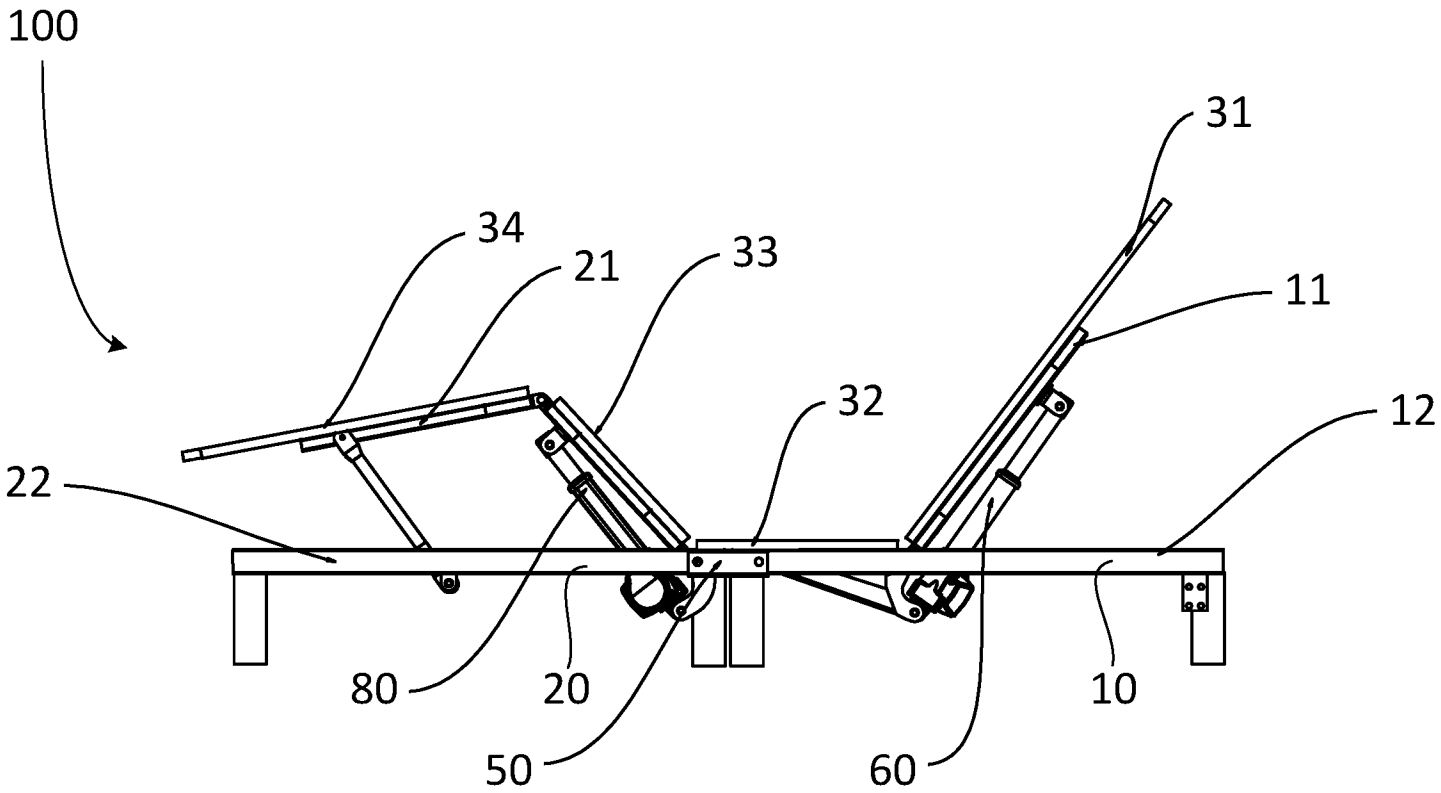
FIG. 3 shows schematically a side view of the foldable bed shown in FIG. 1 in the lifted/adjusted state.

In order to increase the stability during stacking and quickly assemble the foldable bed, the foldable bed 100 in one embodiment further includes a foldable connection mechanism such as a connection rod 50. The two ends of the connection rod 50 are pivotally connected to the back frame 10 and the leg frame 20, respectively. Accordingly, the back frame 10 and the leg frame 20 are pivotally foldable relative to one another at the foldable connection mechanism 50. When the back frame 10 and the leg frame 20 are in a stacked state, the connection rod 50 is in a vertical state to support up and down, as shown in FIG. 4. In addition, cushions 40 can be added between the back frame 10 and the leg frame 20 for a stable support and avoid shaking. When needed to use the foldable bed 100, the back frame 10 and the leg frame 20 are laid out horizontally, the connecting rod 50 is in a horizontal state and connects the back frame 10 and the leg frame 20 to the horizontal direction, as shown in FIGS. 3 and 5.

It should be noted that other designs of the foldable connection mechanism, as disclosed in U.S. patent application Ser. Nos. 16/729,700, 16/747,842, and 17/408,788, which are incorporated herein in their entireties by reference, can also be utilized to practice the invention.

In some embodiments, each 10/20 of the back frame 10 and the leg frame 20 comprises a pair of side rails 12*a*/22*a* and being transversely spaced and longitudinally extended and being parallel to each other, and an upper rail 12*b*/22*b* and a lower rail 12*c*/22*c* being longitudinally spaced and transversely extended. Two ends of the upper rail 12*b*/22*b* are rigidly connected to the first ends of the pair of side rails 12*a*/22*a*, respectively, and two ends of the lower rail 12*c*/22*c* are rigidly connected to the second ends of the pair of side rails 12*a*/22*a*, such that the upper rail 12*b*/22*b* and the lower rail 12*c*/22*c* and the pair of side rails 12*a*/22*a* are co-planar in a rectangle form.

Figure 5:
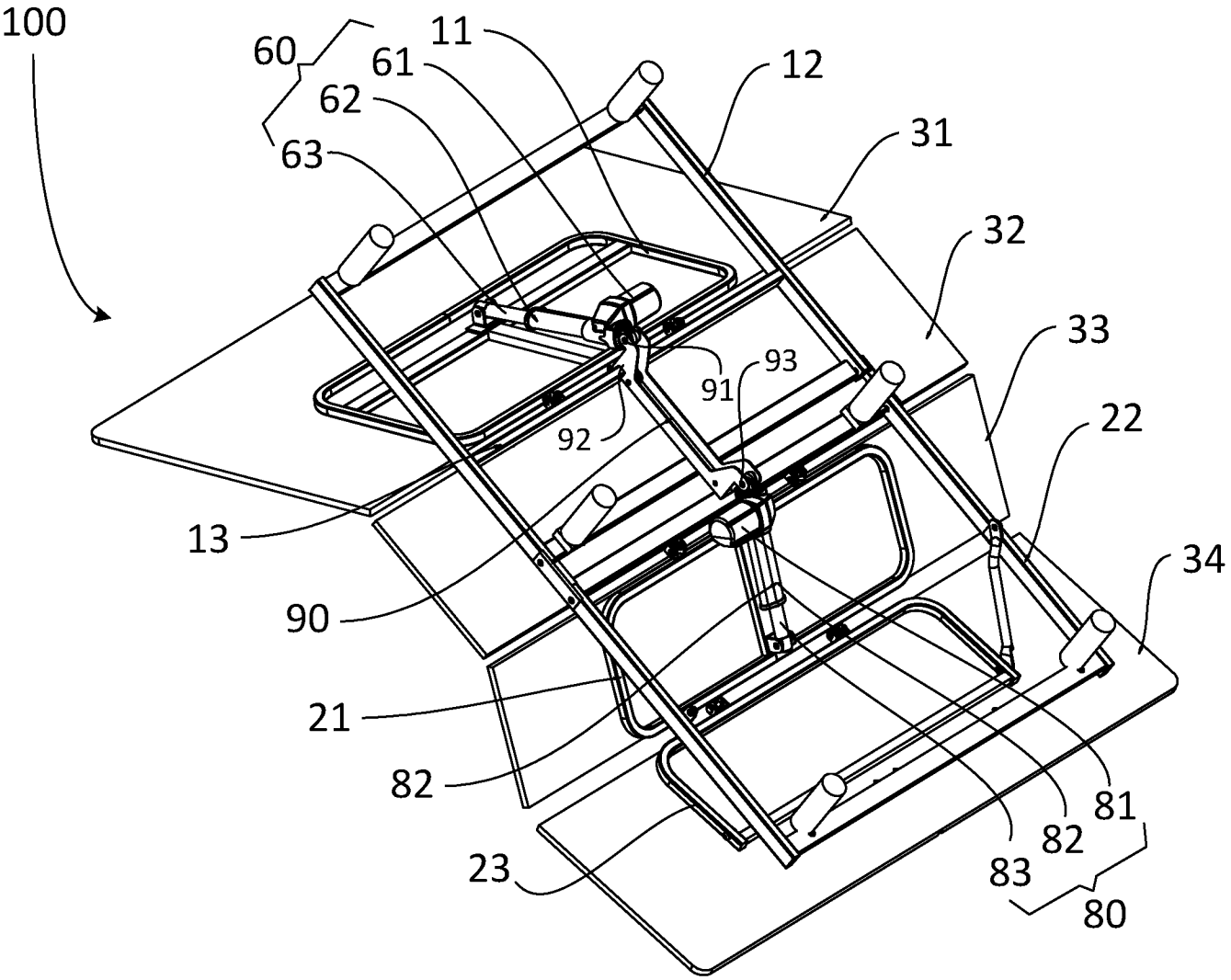
FIG. 5 shows schematically another perspective view of the foldable bed shown in FIG. 1 in the lifted/adjusted state.
Figure 6:
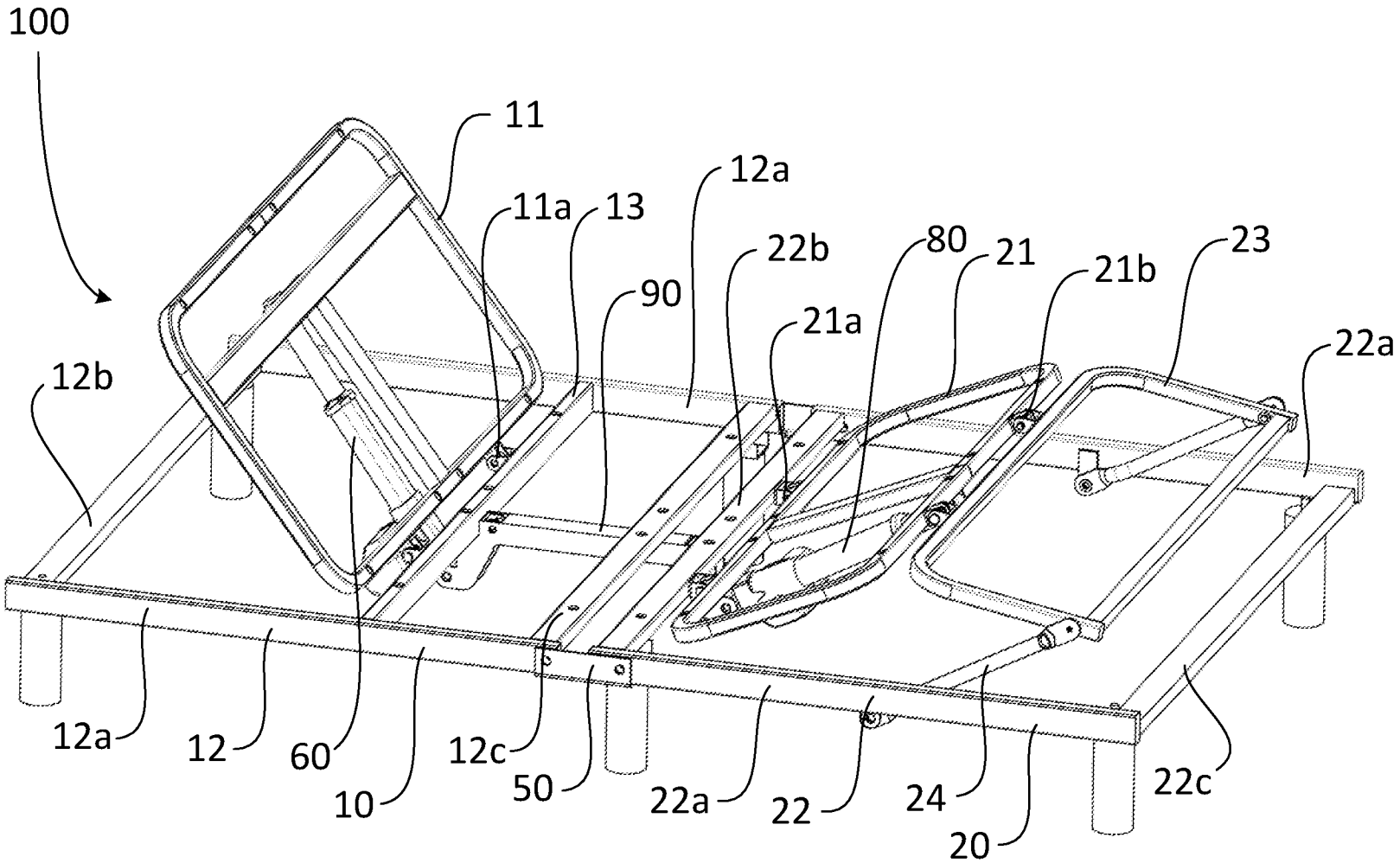
FIG. 6 shows schematically a partially perspective view of the foldable bed shown in FIG. 1 in the lifted/adjusted state.

Additionally, the back frame 10 further comprises a crossbar 13 connected to the pair of side rails 12*a* and positioned between the upper rail 12*b* and the lower rail 12*c*, as shown in FIGS. 5-6.

In order to adjust positions and angles of one or more of the boards 30, the foldable bed 100 can be an electric bed with a driving mechanism to operably adjust the positions and angles of one or more of the boards 30, according to the bed setting preference of the user.

In one embodiments, the back frame 10 also comprise a back lifting bracket 11 is pivotally connected to the crossbar 13. The seat board 32 is detachably mounted onto the pair of side rails 12*a* of the back frame 10 over the lower rail 12*c* and the crossbar 13. The back board 31 is detachably mounted onto the back lifting bracket 11 of the back frame 10. In one embodiment, the back lifting bracket 11 is a frame-shaped bracket.

In one embodiments, the leg frame 20 further comprises a leg lifting bracket comprises a first lifting bracket 21 pivotally connected to the upper rail 22*b* of the leg frame 20, and a second lifting bracket 23 pivotally connected to the first lifting bracket 21. The second lifting bracket 23 is provided with supporting legs 24 pivotally connected to the pair of side rails 22*a* of the leg frame 20. As such, when the first lifting bracket 21 is rotating/swing, it drives the second lifting bracket 23 to move accordingly. The thigh board 33 and the leg board 34 are detachably mounted onto the first and second lifting brackets 21 and 23 of the leg frame 20, respectively. In one embodiment, each of the first and second lifting brackets 21 and 23 is a frame-shaped bracket.

As such, each individual board is independently mounted on a respective lifting brackets, which is convenient to be driven by an independent driving mechanism to realize an individual adjustment of the posture (position and angle) of each group of boards.

It should be noted that other designs of the back and leg lifting brackets, as disclosed in U.S. patent application Ser. Nos. 16/729,700, 16/747,842, and 17/408,788, which are incorporated herein in their entireties by reference, can also be utilized to practice the invention.

In one embodiment, the driving mechanism comprises a back lifting actuator (first driving structure) 60 pivotally connected between the back lifting bracket 11 and the back frame 10 for operably driving the back lifting bracket 11 to pivotally move in an upward rotating direction or a downward rotating direction relative to the back frame 10, thereby causing the back board 31 to swing around its lower edge in a back board downward rotating direction or a back board upward rotating direction according to operations of the back lifting actuator 60. Accordingly, the foldable bed 100 can provide the sitting and lying support of the user by lifting the back board 31.

The driving mechanism also comprises a leg lifting actuator (second driving structure) 80 pivotally connected between the leg lifting bracket 21 and the leg frame 20 for operably driving the leg lifting bracket 21 to pivotally move in an upward rotating direction or a downward rotating direction relative to the leg frame 20, thereby causing the thigh board 33 to swing around its upper edge in a thigh board downward rotating direction or a thigh board upward rotating direction, and the leg board 34 to swing around its upper edge in a leg board downward rotating direction or a led board upward rotating direction according to operations of the leg lifting actuator 80. As a result, the positon and angle of each of the thigh board 33 and the leg board 34 are adjusted.

In one embodiment, each 60/80 of the back and leg actuators 60 and 80 comprises an electric push rod.

Figure 2:
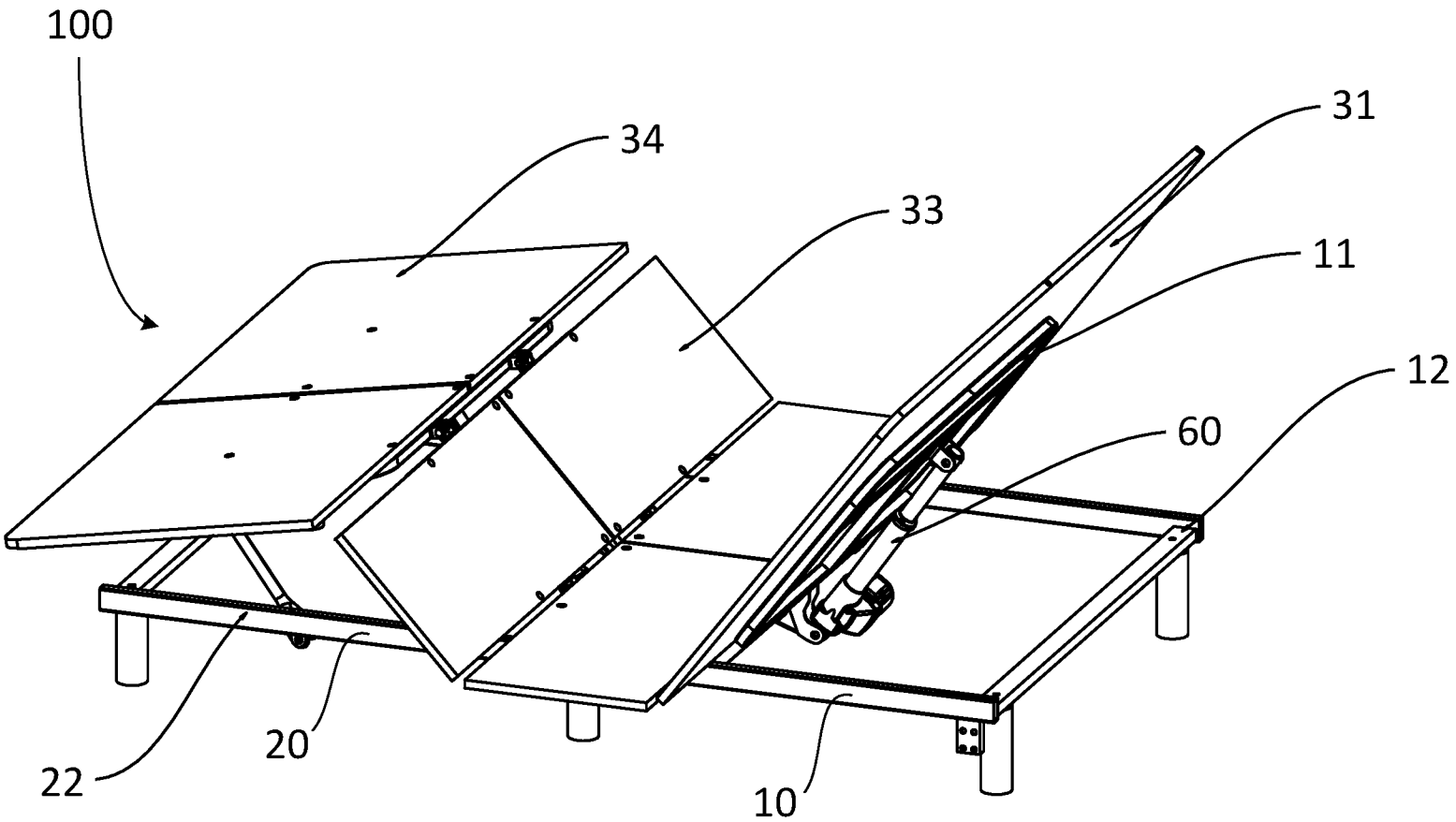
FIG. 2 shows schematically a perspective view of the foldable bed shown in FIG. 1 in a lifted/adjusted state.

In another embodiment, each 60/80 of the back and leg lifting actuators 60 and 80 comprises a motor member 61/81, an outer tube 62/82 extending from the motor member 61/81, and an activation rod 63/83 having a first end portion received in the outer tube 62/82 and an opposite, second end portion pivotally connected to the back lifting bracket 11 or the leg lifting bracket 21. The activation rod 63/83 is engaged with the motor member 61/8 and configured to be telescopically movable relative to the outer tube 62/82 according to a direction of motor rotation. When the activation rod 63/83 expends, it drives the back/leg lifting bracket 11/21 to rotate in an upward rotation direction, thereby lifting the back/thigh board 31/33, so that the foldable bed 100 is in a lifted/adjusted state, as shown in FIGS. 2-3. When the activation rod 63/83 contracts, it drives the back/leg lifting bracket 11/21 to rotate in a downward rotation direction, thereby laying down the back/thigh board 31/33, so that the foldable bed 100 is in a lifted/adjusted state, as shown in FIG. 1.

In one embodiment, the motor members 61 and 81 of the back and leg lifting actuators 60 and 80 are pivotally connected to the back frame 10 and the leg frame 20, respectively.

In another embodiment, the motor members 61 and 81 of the back and leg lifting actuators 60 and 80 are pivotally connected to first and second ends 91 and 93 of a motor bracket 90, respectively. The motor fixing bracket 90 is detachably connected to the bed frame. In one embodiment, the first and second ends 91 and 93 of the motor fixing bracket 90 have hinge holes through which the motor members 61 and 81 are hinged to the motor bracket 90.

Therefore, for the foldable bed 100 to be packaged and transported, the back and leg actuators 60 and 80 and the motor fixing bracket 90 can be detached/removed, so as to fold the bed frame in a pile form, that is, the back frame and the leg frame are directly stacked on one another, which can reduce the overall thickness. In addition, the back and leg actuators 60 and 80 and the motor fixing bracket 90 can be connected in a whole piece. During installation and use, only is the motor fixing bracket 90 fixed to the bed frame.

Figure 7:
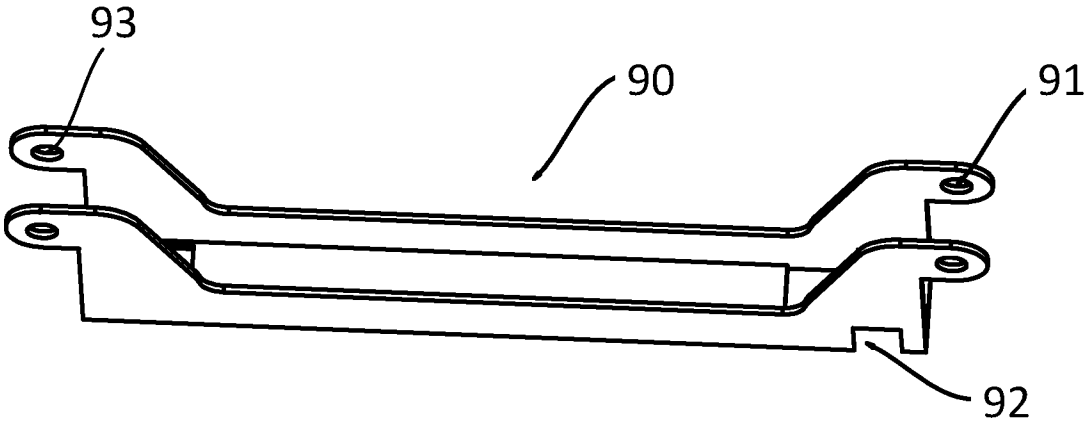
FIG. 7 shows schematically a perspective view of a motor fixing bracket usable in a foldable bed according to one embodiment of the invention.

In one embodiment, in order to quickly install the motor fixing bracket 90, the motor fixing bracket 90 is designed to have a slot 92, as shown in FIG. 7. The slot 92 is configured to clamp on the crossbar 13 of the back frame 10, as shown in FIG. 5. As assembled, the motor fixing bracket 90 is clamped on the cross bar 13 through the slot 92 and fixed to the bed frame by, for example, fasteners. In this embodiment, the clamping slot 92 is used to achieve clamping and positioning and then fastened by the fasteners. Such an embodiment can achieve the positioning installation of the motor fixing bracket 90, which improves the efficiency of installation.

In addition, the foldable bed 100 further includes a controller configured to control operations of the back and leg driving members 60 and 80 individually or cooperatively, so as to lift individually or cooperatively the back board 31, the thigh board 33, and the leg board 34 in desired positions.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A foldable bed, comprising:

a bed frame structure having:

a back frame and a leg frame connecting to the back frame such that the back frame and the leg frame are pivotally foldable relative to one another along a length direction of the foldable bed, wherein each of the back frame and the leg frame comprises a pair of side rails, and an upper rail and a lower rail connected to the pair of side rails in a rectangle form, and wherein the back frame further comprising a crossbar connected to the pair of side rails and positioned between the upper rail and the lower rail;

a back lifting bracket pivotally connected to the crossbar of the back frame;

a leg lifting bracket comprising a first lifting bracket pivotally connected to the upper rail of the leg frame, and a second lifting bracket pivotally connected to the first lifting bracket, wherein the second lifting bracket is provided with supporting legs pivotally connected to the pair of side rails of the leg frame;

a back lifting actuator pivotally connected between the back lifting bracket and the back frame for operably driving the back lifting bracket to pivotally move in an upward rotating direction or a downward rotating direction relative to the back frame;

a leg lifting actuator pivotally connected between the leg lifting bracket and the leg frame for operably driving the leg lifting bracket to pivotally move in an upward rotating direction or a downward rotating direction relative to the leg frame;

wherein each of the back and leg lifting actuators comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the second end portion of the activation rod of the back lifting actuator is pivotally connected to the back lifting bracket, and the second end portion of the activation rod of the leg lifting actuator is pivotally connected to the leg lifting bracket;

a motor fixing bracket detachably connected to the back frame and the leg frame, wherein the motor members of the back and leg lifting actuators are pivotally connected to first and second ends of the motor fixing bracket, respectively; and a plurality of boards detachably attached onto the bed frame structure along the length direction of the foldable bed, wherein each board comprises a pair of panels arranged along a width direction of the foldable bed.

2. The foldable bed of claim 1, further comprising a foldable connection mechanism connecting the back frame and the leg frame such that the back frame and the leg frame are pivotally foldable relative to one another at the foldable connection mechanism.

3. The foldable bed of claim 1, wherein the back lifting bracket is a frame-shaped bracket.

4. The foldable bed of claim 1, wherein each of the first and second lifting brackets is a frame-shaped bracket.

5. The foldable bed of claim 1, wherein the motor fixing bracket comprises a slot that is clamped on the crossbar of the back frame.

6. The foldable bed of claim 1, wherein each of the back and leg actuators comprises an electric push rod.

7. The foldable bed of claim 1, wherein the plurality of boards comprises a back board, a seat board, a thigh board, and a leg board, wherein length and width of a layout of one of the pair of panels of the back board and one of the pair of panels of the seat board are respectively same as length and width of a layout of one of the pair of panels of the thigh board and one of the pair of panels of the leg board, which are also respectively same as length and width of each of the back frame and the leg frame.

8. The foldable bed of claim 7, wherein length and width of each panel of the seat board are respectively same as length and width of each panel of the thigh board.

9. The foldable bed of claim 7, wherein the seat board is detachably mounted onto the pair of side rails of the back frame over the lower rail and the crossbar;

the back board is detachably mounted onto the back lifting bracket of the back frame, such that the back board is operably rotatable around its lower edge in a back board downward rotating direction or a back board upward rotating direction according to operations of the back lifting actuator; and the thigh board and the leg board are detachably mounted onto the first and second lifting brackets of the leg frame, respectively, such that the thigh board is rotatable around its upper edge in a thigh board downward rotating direction or a thigh board upward rotating direction, and the leg board is rotatable around its upper edge in a leg board downward rotating direction or a led board upward rotating direction according to operations of the leg lifting actuator.

* * * * *